United States Patent [19]

Przewalski

[11] Patent Number: 4,776,788

[45] Date of Patent: Oct. 11, 1988

[54] ROTARY KILN

[75] Inventor: Zygmunt J. Przewalski, Granby, Conn.

[73] Assignee: M & S Engineering & Manufacturing Co., Inc., Broad Brook, Conn.

[21] Appl. No.: 64,553

[22] Filed: Jun. 22, 1987

[51] Int. Cl.[4] ..... F27B 7/22

[52] U.S. Cl. ..... 432/103; 432/104; 432/105; 34/108

[58] Field of Search ..... 432/103, 104, 105; 34/108

[56] References Cited

U.S. PATENT DOCUMENTS

| | | | |
|---|---|---|---|
| 3,033,057 | 5/1962 | Gray | 432/103 |
| 3,036,823 | 5/1962 | Taylor | 432/103 |
| 3,320,908 | 5/1967 | Ostrin | 432/103 |
| 3,436,062 | 4/1969 | Raevsky | 432/103 |
| 3,468,522 | 9/1969 | Bovogne | 432/103 |
| 3,517,915 | 6/1970 | Bovogne et al. | 432/103 |
| 3,561,132 | 2/1971 | Grone | 432/103 |
| 3,711,075 | 1/1973 | Raevsky | 432/103 |
| 4,118,180 | 10/1978 | Bliemeister | 432/103 |
| 4,171,949 | 10/1979 | Endersen et al. | 432/104 |
| 4,258,583 | 3/1981 | Weiss et al. | 432/103 |
| 4,344,596 | 8/1982 | Hjaeresen | 432/103 |
| 4,403,952 | 9/1983 | Birch et al. | 432/103 |

*Primary Examiner*—Henry C. Yuen

*Attorney, Agent, or Firm*—Hayes & Reinsmith

[57] ABSTRACT

A kiln is disclosed which includes an elongated housing formed by a plurality of interconnected longitudinally extending sections each forming an independent housing module. Each housing module has support means for rotatably supporting that housing module independently of any other module and power means for moving the support means of each housing module into contact engagement therewith for compensating for load variations applied to the support means and uniformly distributing the loading forces imposed thereon by the housing modules and their respective contents.

7 Claims, 4 Drawing Sheets

ROTARY KILN

FIELD OF THE INVENTION

This invention generally relates to incinerators and particularly concerns a rotary kiln for disposing of large volumes of waste.

BACKGROUND OF THE INVENTION

An accepted method of disposing of a variety of different types of waste materials is burning those materials in an incinerator of a rotary kiln type. Such incinerators are particularly suitable for mass destruction of waste as the waste materials are tumbled inside an internal incinerating chamber of the kiln to effect complete burning of all combustible materials. The rotary kiln is a main component of such incinerators, but it has normally been limited with regard to its size in relation to its mechanical characteristics.

More specifically, a conventional rotary kiln is normally a steel cylinder with an internal refractory lined chamber, the cylinder usually being supported by four wheels engageable with two external circular tracks or rails. When the rotary kiln is of a large size, required to satisfy a specified process requirement, its weight normally has been found to become too much to be supported by four wheels. As the kiln size increases, greater precision is also required for aligning the wheels with their respective rail to obtain uniform support of the rotary kiln. Such manufacturing precision may be prohibitively costly to achieve when the size of the kiln is relatively large. However, if such precision is not achieved and all of the wheels are not in uniform and firm contact with the rail, damage will result to both the wheels and rail. This condition is normally due to inaccuracy of manufacturing and because those wheels which carry the load may become overloaded and gouge the rail.

OBJECTS OF THE INVENTION

A principal object of this invention is to provide a new and improved rotary kiln featuring a support mechanism for eliminating the above defined problems and which provides both a simple and inexpensive construction for rotary kilns of enlarged size.

Another object of this invention is to provide a rotary kiln of the type described which is particularly suited to be of a relatively increased length without accompanying proportionate cost increases. This aim is achieved by the provision of the above referenced support mechanism which is a simple mechanical construction which effectively achieves the seemingly incompatible objectives of significantly increasing the capacity of the rotary kiln while at the same time readily providing for the requisite uniform and firm rotary support of the track or rail of the kiln by its support wheels.

Other objects will be in part obvious and in part pointed out in more detail hereinafter.

Figure 1:
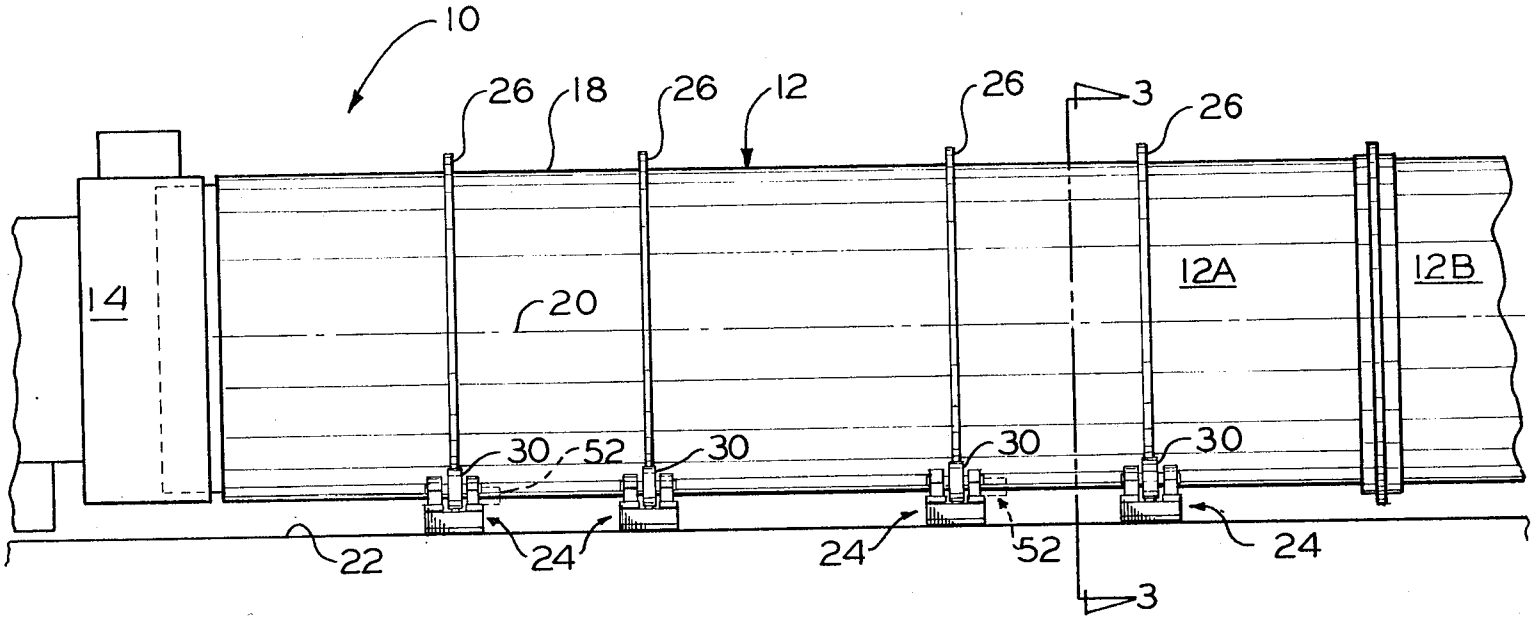
FIG. 1 is a schematic side view, partly broken away, of a rotary kiln of this invention.

A better understanding of the objects, advantages, features, properties and relations of the invention will be obtained from the following detailed description and accompanying drawings which set forth an illustrative embodiment and is indicative of the way in which the principle of the invention is employed.

DETAILED DESCRIPTION OF A PREFERRED EMBODIMENT

Referring now to the drawings in detail, an incinerator 10 is provided which incorporates a rotary kiln 12. It is to be understood that kiln 12 has an input end wherein a feeder 14 of the incinerator 10 serves to convey waste (not shown) into an internal incinerating chamber 16 (FIG. 3) which is refractory lined. Kiln 12 comprises a housing which is of elongated configuration having a longitudinally extending major axis 10 and a cylindrical external housing wall 18. Kiln 12 will be understood to be suitably mounted in a stationary condition on a fixed foundation 22 or may be supported on a portable unit such as a trailer, not shown, which in turn may be adapted to be drawn by a power operated vehicle, not shown.

Figure 2:
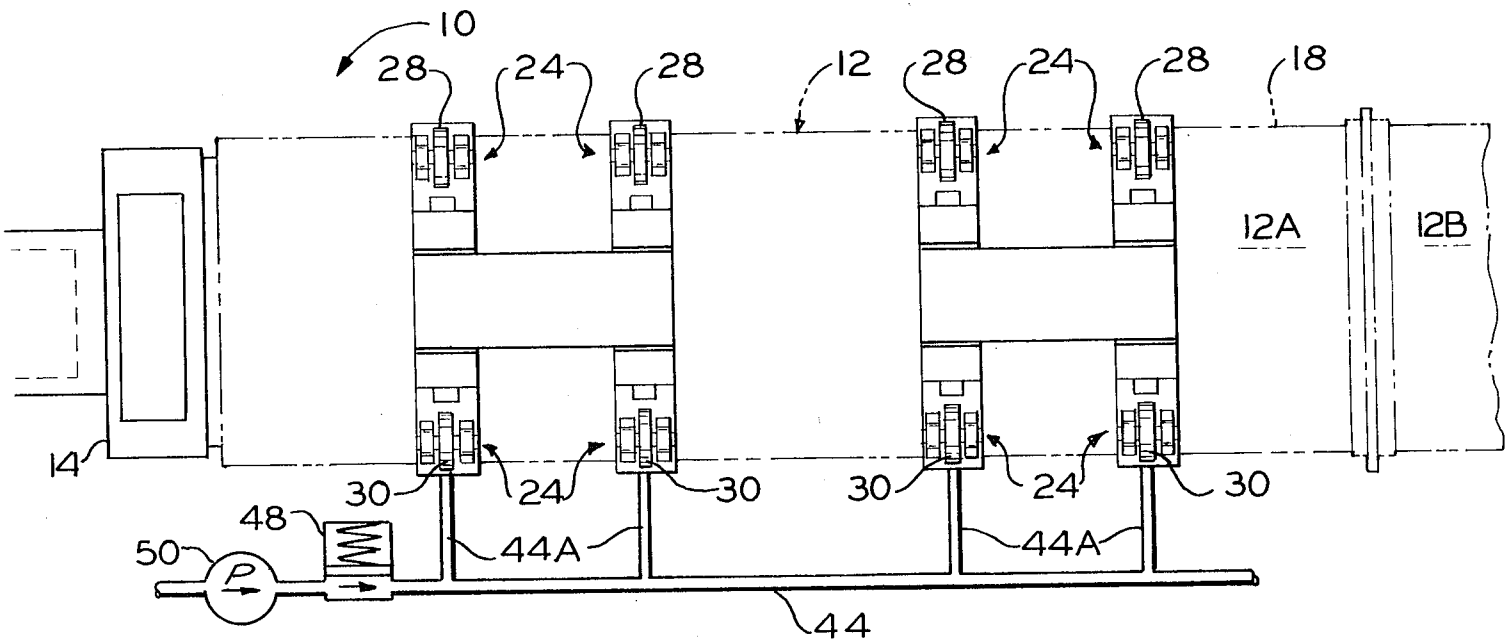
FIG. 2 is a schematic plan view of the rotary kiln of FIG. 1, shown in broken lines, incorporating a power system, shown in full lines, for maintaining support wheels of the rotary kiln in engagement with their respective rails.

To meet ever increasing demands for the disposal of huge volumes of wastes on a mass destruction scale, rotary kiln 12 of this invention is particularly designed to provide a support means or mechanism 24 which eliminates the heretofore commonly encountered problems associated with the provision of enlarged rotary kilns and at the same time provides a simple and inexpensive means of permitting construction of such kilns without limitation as to size, particularly the length of such kilns. The rotary kiln 12 of this invention is formed of discrete interconnected longitudinally extending sections each of which forms an independent housing module. In the drawings, FIGS. 1 and 2 show a single housing module at 12A and an interconnected adjacent housing module at 12B. To permit the construction of elongated kilns without corresponding increases in cost, each housing module 12A, 12B, e.g., includes separate support mechanisms 24 for rotatably supporting each housing module independently of any other module of the housing.

Figure 3:
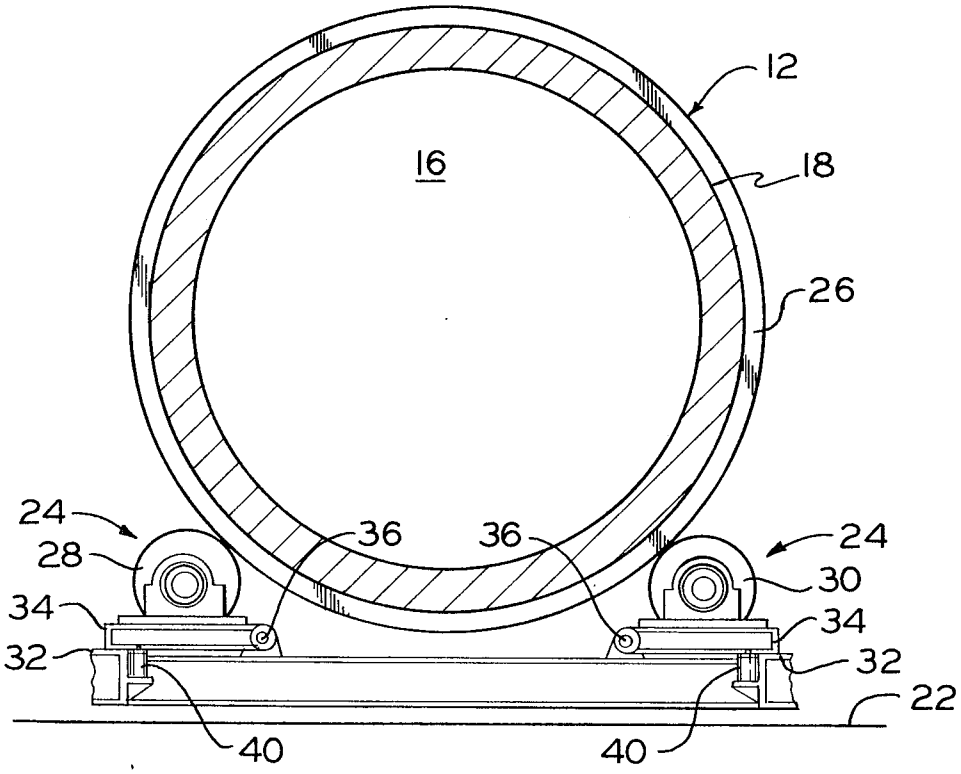
FIG. 3 is an enlarged cross-sectional view, partly broken away, taken generally along line 3—3 of FIG. 1.

As best seen in FIG. 3, wall 18 of each housing module 12A, 12B includes a generally circular track or rail 26 which is mounted on the housing module and circumferentially extends externally about its wall 18. The support mechanism 24 for each housing module 12A, 12B includes at least a pair of wheels 28, 30 wherein each of the pair of wheels 28, 30 is engaged with a rail 26 of its respective housing module 12A (or 12B, e.g.).

In accordance with this invention, each housing module 12A, 12B includes a base 32, and a platform 34, the base 32 being in underlying relation to its respective housing module 12A or 12B and its platform 34 being mounted on its base 32 for swinging movement about its pivot axis 36. Pivot axis 36 is defined by a shaft mounted on base 32 and supporting platform 34 for swinging movement. The pivot axis 36 of each housing module 12A, 12B extends in parallel relation to longitudinally extending major axis 20 of housing 18.

Figure 4:
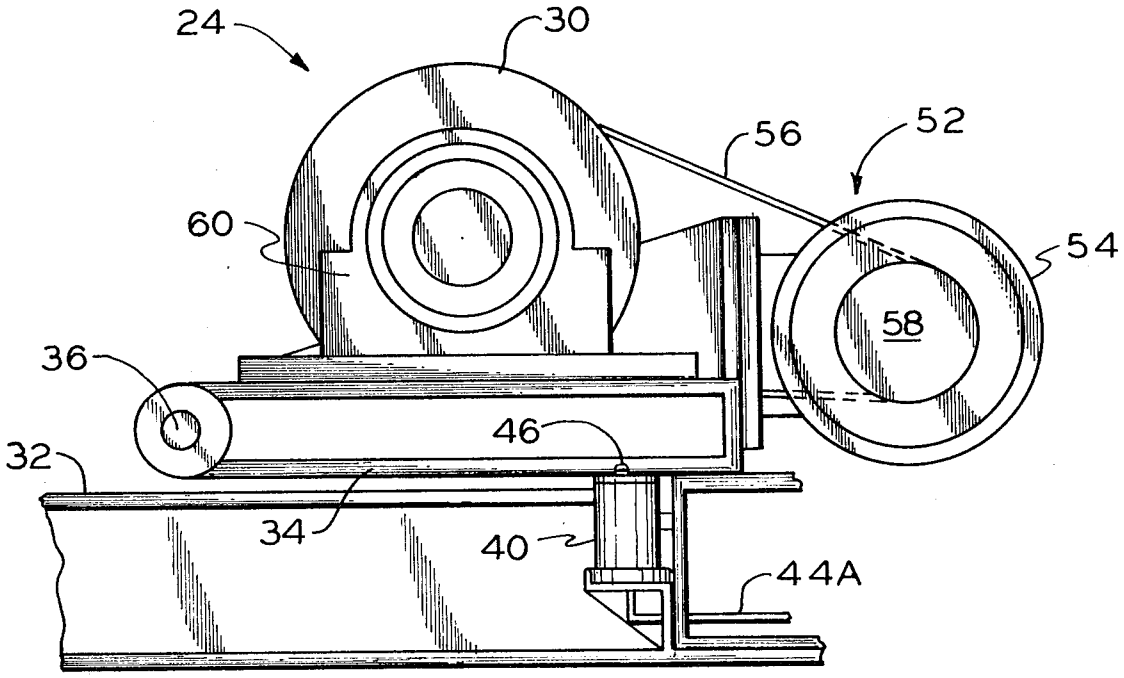
FIG. 4 is a further enlarged fragmentary view showing details of a rail support wheel and power operated drive for the rotary kiln of FIG. 1.

To move each wheel 28, 30 into engagement with its respective housing module rail 26, each swinging platform 34 is provided with a power cylinder 40 connected to a common source, not shown, of pressurized fluid via fluid lines 44, 44A. Each power cylinder 40 has a longitudinally extensible and retractable piston rod 46 (FIG. 4) operated by power cylinder 40 and drivingly connected to its respective swinging platform 34 for moving its wheel 28 (or 30) into engagement with its respective housing module rail 26. In the specifically illustrated embodiment, power cylinder 40 is shown as being connected by fluid lines 44, 44A to the source of pressurized fluid in a fluid system incorporating a mechanical pressure accumulator 48 immediately downstream of a suitable power operated pump 50. Accordingly, the mechanical pressure accumulator 48 serves as a control means for maintaining the fluid pressure in each of the lines 44, 44A at a uniform level, thereby compensating for load variations applied to each wheel 28, 30 and uniformly distributing the loading forces imposed thereon by the housing modules 12A, 12B and their respective contents. In viewing FIG. 2, it is to be understood that the fluid system is only shown in part for purposes of clarity and that each of the respective pairs of wheels such as at 28 and 30 are individually connected by way of suitable fluid lines such as at 44A to the common source of pressurized fluid. Accordingly, each wheel 28, 30 will be understood to be suitably mounted on its respective swinging platform 34 to be moved into engagement with its respective housing module rail 26.

In addition, this invention provides for a power operated drive 52 wherein at least one wheel of each pair of wheels 28, 30 is drivingly connected to that power operated drive 52 for rotating its respective housing module 12A, 12B. In the illustrated embodiment, power operated drive 52 is shown in FIG. 1 in broken lines and includes a motor 54 (FIG. 4) mounted on swinging platform 34. A drive belt 56 is trained between a drive shaft 58 of motor 54 and wheel 28 (or 30) to in turn drive a housing module 12A (12B), each of wheels 28, 30 being respectively supported by a suitable bearing 60 mounted on swinging platform 34. As illustrated, power operated drive 52 is connected to a selected wheel or wheels 28, 30 of each housing module 12A, 12B and, if desired, the power operated drive 52 may be provided for each wheel 28, 30 and will be understood to cooperate therewith to accordingly serve to provide each of the wheels 28, 30 as a drive wheel for each housing module 12A, 12B to rotate each of the housing modules in sychronism with one another, thereby to uniformly rotate housing 18 as a unit.

By virtue of the above described construction, any of the support wheels 28, 30 which may be used as a drive member for a housing module provides a further advantage in providing a drive featuring rolling friction between drive wheels 28, 30 and housing module rails 26. Hence, when starting housing 18 of rotary kiln 12 in motion, there is, in fact, a little slippage which permits the load to be gently picked up, in sharp contrast with conventional gear teeth drives wherein it is virtually required to instantaneously come up to speed. This advantage is of very real significance in dealing with large diameter drums of significant lengths and containing considerable amounts of waste materials wherein the inertia of the entire system becomes a critical factor. The described construction eliminates the necessity encountered with conventionally constructed kilns to create exceedingly rigid lengths of beams to support the cylinder or housing against deflection about its support positions. Rather, with this invention, a plurality of housing modules and their respective support mechanism can be combined to form various lengths of housing and thereby eliminate need for any extremely rigid construction of the housing itself as normally required in conventional constructions. The cost of the kiln of this invention is reduced, the weight of the kiln of this invention is reduced, and yet an overall improved support system is provided ensuring that the rotating kiln will be uniformly and proportionately supported by each of the support mechanisms by virtue of their ability to pivot and to maintain a desired constant fluid pressure applied by the described power means of the system.

As will be apparent to persons skilled in the art, various modifications, adaptations and variations of the foregoing specific disclosure can be made without departing from the teachings of this invention.

I claim:

1. A rotary kiln comprising an elongated housing having a longitudinally extending major axis, an external wall and an internal incinerating chamber, the housing including a plurality of interconnected longitudinally extending sections each forming an independent housing module, a base disposed in underlying relation to each housing module, a swinging support for rotatably supporting each housing module, each swinging support being mounted on the base for swinging movement about a pivot axis extending in parallel relation to the major axis of the housing, a wheel mounted on each swinging support for movement therewith into contact engagement with its respective housing module for rotatably supporting the same independently of any other housing module, and power means for moving the swinging support and wheel of each housing module.

2. The kiln of claim 1 wherein the wall of each housing module includes a generally circular rail mounted on and circumferentially extending about its wall, wherein the wheel comprises a power operated drive wheel in drivingly engaged relation with the rail of its respective housing module, and wherein drive means is connected to the power operated drive wheel of each housing module, the drive means cooperating with the drive wheel of each housing module to rotate each of the housing modules in synchronism with one another.

3. The kiln of claim 2 further including a motor mounted on the swinging support for driving the drive wheel of each housing module.

4. The kiln of claim 1 wherein the swinging support comprises a platform, wherein the pivot axis is defined by a shaft mounted on the base and supporting the platform for swinging movement, the shaft extending in parallel relation to the longitudinally extending major axis of the housing.

5. The kiln of claim 1 wherein the power means includes a common source of pressurized fluid, and wherein a power cylinder is provided for each swinging support, each power cylinder being connected to the common source of pressurized fluid and having a longitudinally extensible and retractable piston rod operated by the power cylinder and drivingly connected to its respective swinging support for moving its wheel into engagement with its respective housing module.

6. The kiln of claim 5 further including a fluid line connected from the common source of pressurized fluid to each power cylinder, and control means for maintaining the fluid pressure in each of the lines at a uniform level, thereby compensating for load variations applied to the wheels and uniformly distributing the loading forces imposed thereon by the housing modules and their contents.

7. The kiln of claim 2 further including a second wheel for each housing module mounted on the base and being engaged with the rail of its respective housing module

* * * * *

UNITED STATES PATENT AND TRADEMARK OFFICE

CERTIFICATE OF CORRECTION

PATENT NO. : 4,776,788

DATED : October 11, 1988

INVENTOR(S) : Zygumnt J. Przewalski

It is certified that error appears in the above-identified patent and that said Letters Patent is hereby corrected as shown below:

Column 2, line 23 wherein the words "axis 10"should be --axis 20--.

Signed and Sealed this

Twenty-second Day of August, 1989

*Attest:*

DONALD J. QUIGG

*Attesting Officer*

*Commissioner of Patents and Trademarks*